US007145479B2

(12) United States Patent
Fastenrath

(10) Patent No.: US 7,145,479 B2
(45) Date of Patent: Dec. 5, 2006

(54) METHOD FOR PROVIDING TRAFFIC INFORMATION

(75) Inventor: Ulrich Fastenrath, Neuss (DE)

(73) Assignee: DDG Gesellschaft fuer Verkehrsdaten mbH, Duesseldorf (DE)

( * ) Notice: Subject to any disclaimer, the term of this patent is extended or adjusted under 35 U.S.C. 154(b) by 66 days.

(21) Appl. No.: 10/800,327

(22) Filed: Mar. 12, 2004

(65) Prior Publication Data

US 2004/0233071 A1 Nov. 25, 2004

(30) Foreign Application Priority Data

Mar. 14, 2003 (DE) ..... 103 12 502

(51) Int. Cl.
*G08G 1/123* (2006.01)

(52) U.S. Cl. ..... 340/995.13; 340/905; 701/211

(58) Field of Classification Search ..... 340/995.13, 340/995.12, 905; 701/211, 213, 117
See application file for complete search history.

(56) References Cited

U.S. PATENT DOCUMENTS

| | | | | |
|---|---|---|---|---|
| 5,406,490 | A * | 4/1995 | Braegas | 701/210 |
| 5,933,094 | A * | 8/1999 | Goss et al. | 340/905 |
| 6,236,933 | B1 * | 5/2001 | Lang | 701/117 |
| 6,333,703 | B1 * | 12/2001 | Alewine et al. | 340/995.13 |
| 6,845,316 | B1 * | 1/2005 | Yates | 701/117 |

* cited by examiner

*Primary Examiner*—Brent A. Swarthout
(74) *Attorney, Agent, or Firm*—Cohen, Pontani, Lieberman & Pavane

(57) ABSTRACT

A method for providing traffic information concerning one or more specific sections of a route to a traveler includes the steps of generating a bundle of traffic advisory messages for the traveler when an event relevant to the traffic situation has occurred in an affected section of the highway, wherein each of the traffic advisory messages present in the bundle of traffic advisory messages describes the traffic-relevant event in question at a different time within a defined interval and selecting a relevant message from the bundle of traffic advisory messages which is valid at a time relevant to the traveler.

13 Claims, 3 Drawing Sheets

METHOD FOR PROVIDING TRAFFIC INFORMATION

BACKGROUND OF THE INVENTION

1. Field of the Invention

The present invention relates to a method for providing traffic information to a traveler concerning one or more specific sections of a route.

2. Description of the Related Art

Traffic advisory messages are known as the dominant form of delivery for up-to-date traffic information. The traffic advisory message is a data file which gives information concerning a traffic flow situation such as the location, extent, type, and possibly other properties, the traffic flow situation typically being a situation in which the flow of traffic is being hindered in some way. The traffic advisory message may be presented to recipient in various ways, e.g., it can be read over the radio, called up via a menu-controlled voice dialog system, noted while performing a navigation task, viewed in the form of text on display unit, or using other forms of communication.

An important criterion for the quality of the traffic information composed in the form of an advisory is its currency. The longer the period of time which passes between the moment at which the advisory is valid and the moment at which it is relevant to the recipient, the greater the probability that all of the details of the traffic advisory will no longer accurately reflect the situation which the user will actually find at the location in question if he actually goes there after having learned of the content of the advisory.

There are five different factors which determine this period of time, referred to in the following as the "advisory delay". The four most important ones are listed here:

1. the gap of time between the time when the event occurs on the highway and the time when it is observed for the first time and reported to a central location;

2. the time it takes for a suitable traffic advisory to be composed at the central location;

3. the time required for the dissemination of the advisories according to certain procedures for dissemination, e.g., because the procedures are periodic; and 4. the usually false assumption of the recipient that the traffic advisory which has reached them continues to be valid without change until the recipient actually reaches the location of the reported event.

The delays in the delivery of the advisory message acquire a subjective and individual component especially as a result of the fourth of the above-listed factors. The existing dissemination channels and terminals are designed to receive traffic information in the form of advisory messages.

SUMMARY OF THE INVENTION

An object of the present invention is to provide traffic advisories such that the traffic information sent to a traveler is information which is essential to him at the time he actually arrives at the event relevant to the traffic situation.

The object of the present invention is met by a method for providing traffic information concerning one or more specific sections of a route to a traveler, including the steps of generating a bundle of traffic advisory messages for the traveler when an event relevant to the traffic situation has occurred in an affected section of a highway, wherein each of the messages present in the bundle describes the traffic-relevant event at a different time within a defined interval, and selecting a relevant message which is valid at a time relevant to the traveler from this bundle.

According to the present invention a bundle of messages $M_i$ is provided instead of an individual message M. Each message in the bundle describes the event at a different time, namely, at the validity time $T_i=t_0+i\Delta t$, where $t_0$ stands for the present time (or, more precisely, for the time at which the message bundle is made available), and $\Delta t$ stands for the time interval between the individual messages within the bundle. A typical value could be: $\Delta t=5$ min.

As supporting information, message bundles can be supplemented by a bundle of travel time matrices $\tau_{kl}^{(i)}$, the entries of which state the travel times which are necessary at time $T_i$ to travel from the end of the problem belonging to one bundle $M_i^{(k)}$ to the beginning of the problem belonging to the bundle $M_i^{(l)}$.

Both the message bundle and also the bundle of travel time matrices are objects which are discrete in time, but it is necessary to access their contents at any desired time. Therefore, the access function $n(t)=i$ is required if $T_i-\frac{1}{2}\Delta t \leqq t \leqq T_i+\frac{1}{2}\Delta t$, which returns the index of the entry of the message bundle which is closest in time.

With respect to the inventive use of the message bundle, it is also advantageous for each of the individual messages to contain the attribute "transit time" $\tau(M_i)$, which gives the time which is required at time $T_i$ to travel through the traffic problem belonging to $M_i$.

The most interesting entries in a message bundle are those with validity times which are still in the future. There are various methods of traffic prediction available for generating these entries, but they are not the object of the present invention. It is possible, for example, to treat an already known problem by a process of congestion prediction. That is, if the volume of traffic entering the problem area and the volume of traffic leaving the problem area are known, it is possible to determine the most likely location of the congestion fronts at the validity times in question. In this way, the growth or disappearance of a traffic problem over the course of time can be described and integrated into the message bundle. In addition, it is also possible to extrapolate the traffic situation into the future on the basis of increases in traffic volume or on the basis of historical data even if a problem has not yet been observed. Corresponding predictions can be entered into the message bundle such as, for example, "Traffic congestion is probable from . . . until . . . o'clock", to characterize explicitly the uncertainty of the prediction of a "congestion coming out of nowhere". The situation may be quantified even further by indicating the degree of probability, such as "there is a 75% likelihood of congestion from . . . until . . . ".

The entry of past values into the message bundle is not absolutely necessary for the purposes of dynamic navigation, but it can definitely be taken into consideration by the recipient, i.e., traveler, as a confidence-building measure (also for other purposes, such as backtracking). If it is clearly evident from the message bundle that the length of a traffic problem has grown worse over the course of the preceding 15 minutes, i.e., from 5 to 7 to 9 km, the traveler obtains a very clear picture of the situation.

The message bundle must be evaluated after it is has been provided. This may be performed by a service provider, who knows enough about the traveler to select for him the relevant message from the bundle. The evaluation may also be performed, however, after the bundle has arrived at a terminal of the traveler, and may also be performed by the traveler himself.

Knowledge of the route which the traveler is planning to take is certainly helpful with respect to the accuracy of the information which reaches him, but it is not absolutely necessary. Thus, if the traveler is not sure of the route he is going to take at the time he requests the relevant information, the process of selecting messages from the bundle may be done on the basis of linear distances and speeds assumed for certain classes of roads instead of on the basis of the actual distances and possible speeds on the highway system.

The message bundle must be limited in time, i.e., covers a certain time period having a start time and an end time. The current index cannot assume any arbitrary value but rather must be taken from a limited quantity of indices: $i \in [i_{min}, \ldots, i_{max}]$ . The lower limit $i_{min}$ (start time) can be selected arbitrarily under aspects such as the maximum amount of data to be transmitted or a reasonable temporal barrier for historical information. The upper limit $i_{max}$ (end time) however, depends on the predictability of the data acquisition and processing system involved. Here it is possible, for example, on the basis of service requirements, to define a fixed upper limit $i_{max}$ and to characterize the credibility of the corresponding prediction by, for example, a value which characterizes the probability of a traffic congestion situation (see above). It would also be possible to impose minimum requirements on the quality of the prediction, from which a variable prediction horizon and thus a variable upper limit $i_{max}$ will follow.

In a large highway network, finally, message bundles do not necessarily have to be represented as such in terms of the above described data technology. It is possible, for example, for two traffic problems to merge into one or for one traffic problem to split into two. This does not make it impossible to represent the change over time in the form of bundles, but it does make it more difficult. It is therefore possible to imagine combining all the descriptions of the entire network into a single bundle, where the descriptions can contain different numbers of messages at each validity time. This makes it easier to create the message bundles, but also makes it more difficult to use them. In terms of the data technology, therefore, a method suited to the application in question should be selected to represent the information.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
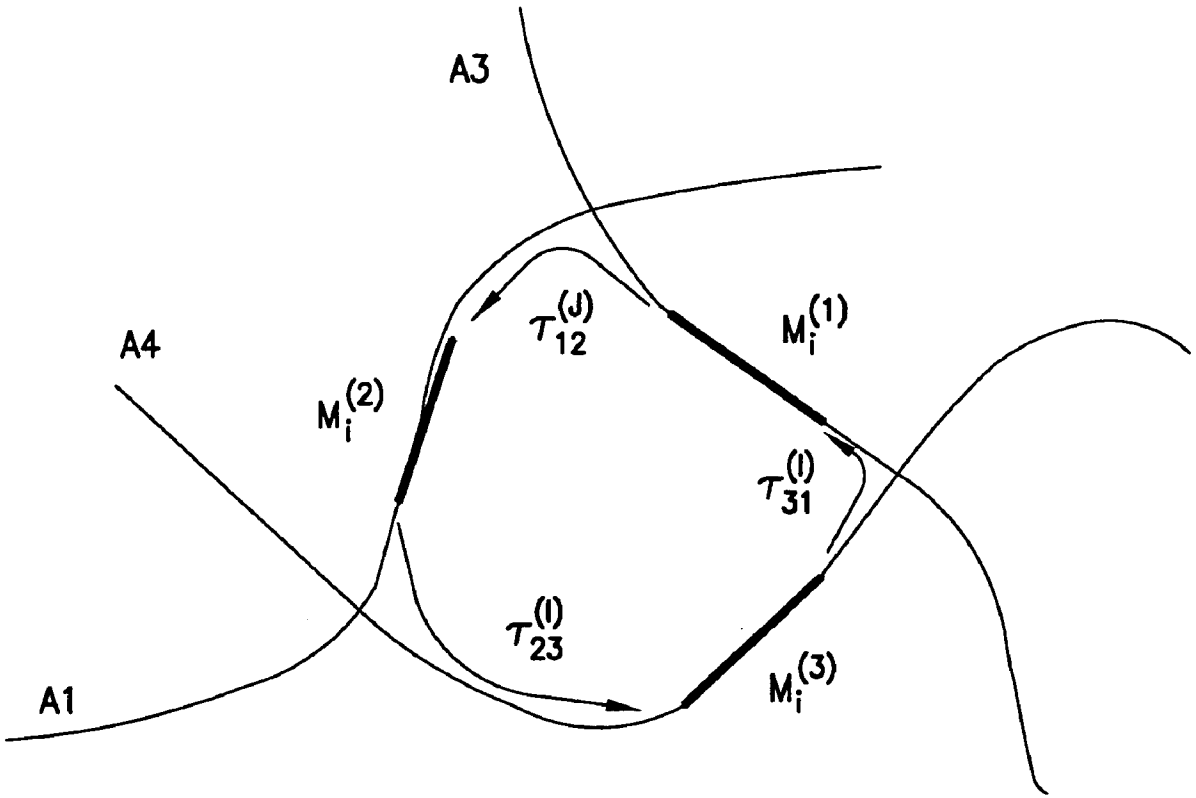
FIG. 1 is a plan view showing a highway network with a ring structure.

In FIG. 1, the network is covered by 3 message bundles $M^{(1)}$, $M^{(2)}$, and $M^{(3)}$ and by a bundle of travel matrices $\tau$ of the form:

$$\tau^{(i)} = \begin{pmatrix} - & \tau_{12}^{(i)} & \tau_{12}^{(i)} + \tau(M_{i'}^{(2)}) + \tau_{23}^{(i')} \\ \tau_{23}^{(i)} + \tau(M_{i'}^{(3)}) + \tau_{31}^{(i)} & - & \tau_{23}^{(i)} \\ \tau_{31}^{(i)} & \tau_{31}^{(i)} + \tau(M_{i}^{(1)}) + \tau_{12}^{(i)} & - \end{pmatrix}.$$

Figure 2:
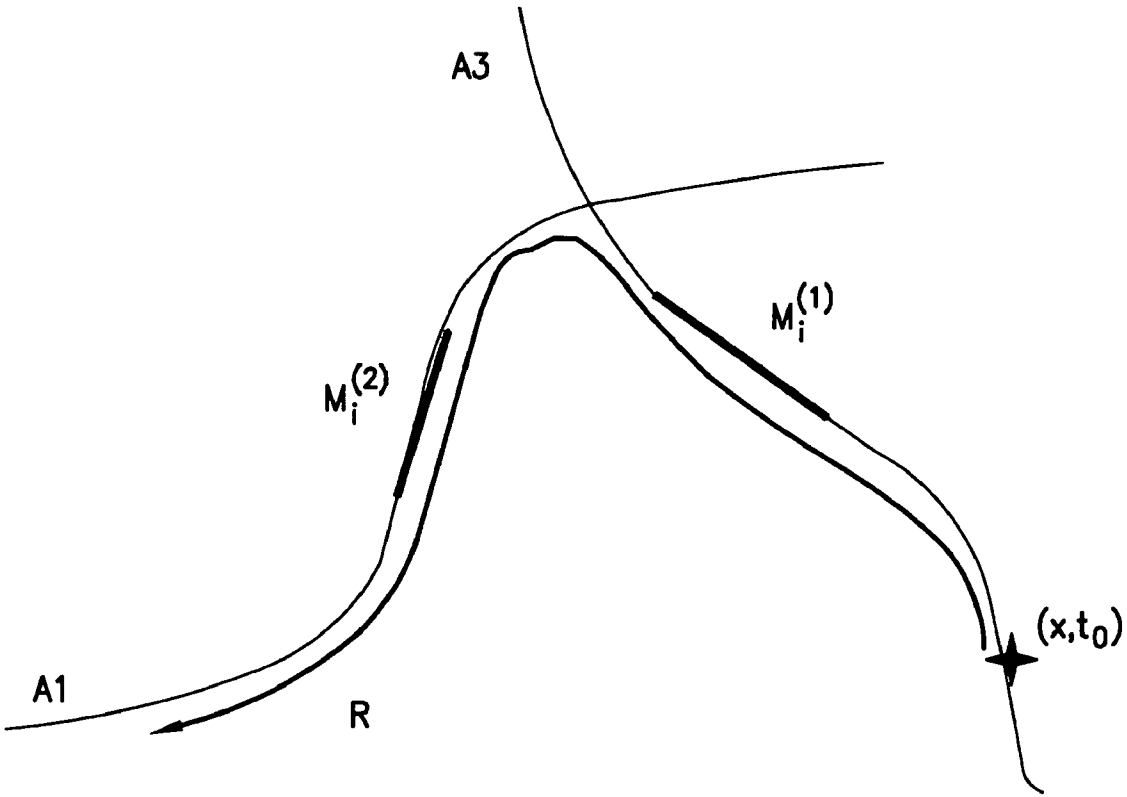
FIG. 2 is a plan view of a portion of this ring structure with the route being taken by a user.

FIG. 2 illustrates a portion of the network of FIG. 1 with a user at location x at time $t_0$ having a route R, which is covered by the two message bundles $M^{(1)}$ and $M^{(2)}$, calculated for him.

From the location of the user at the time of the request, it is possible to determine the amount of time $T_0$ it will probably take to reach the problem described by the message bundle $M^{(1)}$. With the help of an access function $n(t)=i$, if $T_i-\frac{1}{2}\Delta t \leqq t \leqq T_i+\frac{1}{2}\Delta t$, the message which presumably best describes the event at the time the user arrives at the location of the *event*, *namely*, $M^{(1)}{}_{n(t0+T0)}$, can be selected from the message bundle $M^{(1)}$, wherein $t_0$ is the time that the message bundle $M^{(1)}$ is made available and $T_0$ is the time it will probably take the user to reach the problem described by the message bundle $M^{(1)}$.

So that the message from the next message bundle $M^{(2)}$ which describes the event at the time that the user arrives at the location of the event can be extracted from the next message bundle $M^{(2)}$ lying on the route, the time must be determined which it will presumably take for the user to arrive at $M^{(2)}$. It will take the user the travel time $T'_1=T_0+\tau(M_{n(t0+T0)}{}^{(1)})$ to leave $M^{(1)}$, wherein $T_0$ is the time it takes for the user to reach the location of the problem described by $M^{(1)}$ and $\tau(M_{n(t0+T0)}{}^{(1)})$ is the time it takes to drive through the area described by message bundle $M^{(1)}$ at the time $t_0+T_0$ that the user reaches the location of the event described by message bundle $M^{(1)}$. The travel time it will take to arrive at $M^{(2)}$ is given by $T_1=T'_1+\tau_{12}{}^{(n(t0+T'1))}$, wherein $T'_1$ is the time is will take the user to leave $M^{(1)}$ and $\tau_{12}{}^{(n(t0+T'1))}$ is the time is will take the user to drive from the end of the problem described by message bundle $M^{(1)}$ to the location of the problem described by $M^{(2)}$ at the time $t_0+T'_1$ that the user leaves $M^{(1)}$. Thus, the message $M_{n(t0-T1)}{}^{(2)}$ is to be selected from $M^{(2)}$ to estimate the impression which the user will have regarding the actual site in question when the user reaches the location of the problem described by $M^{(2)}$. In this way, it is possible to take into account in iterative fashion any desired number of message bundles lying on the calculated route.

Figure 3:
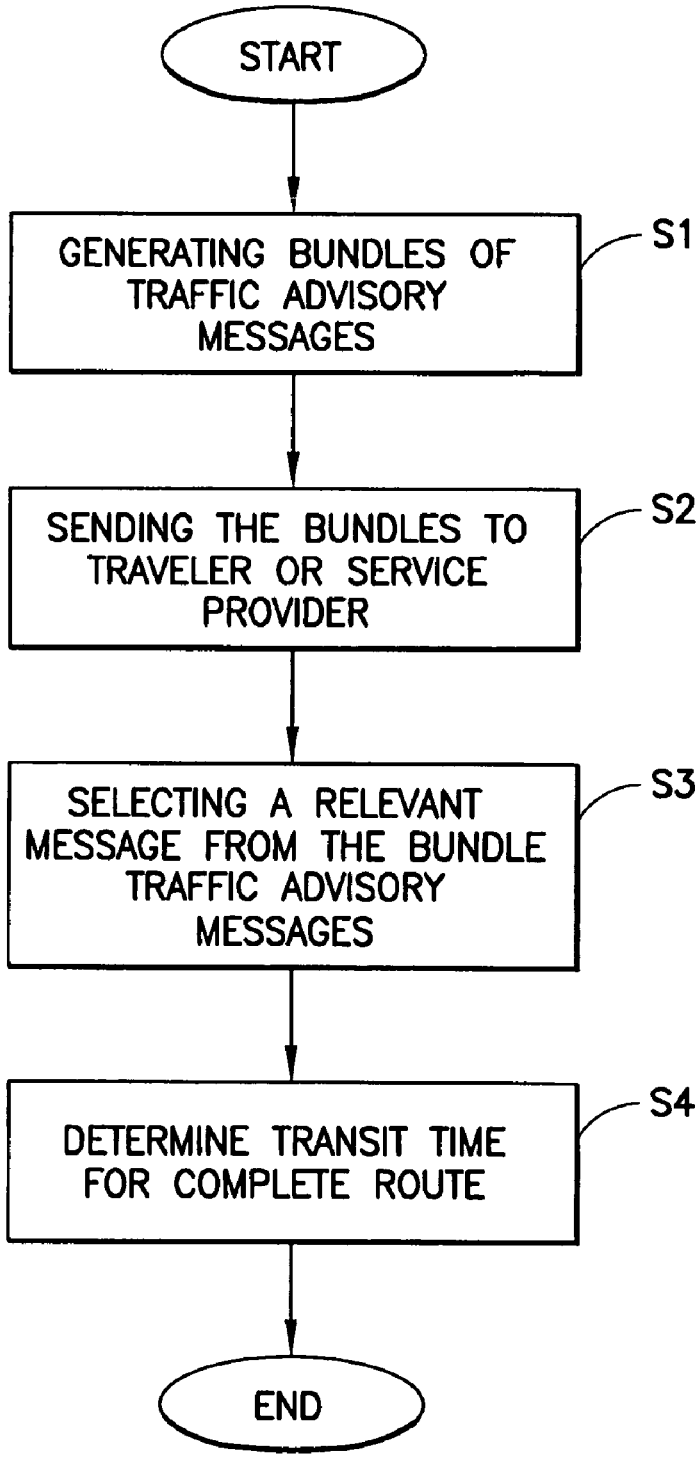
FIG. 3 is a flow diagram illustrating the method according to an embodiment of the present invention.

As shown in FIG. 3, the present invention includes the step of generating a bundle of traffic advisory messages for a traveler when an event relevant to a traffic situation occurs in an affected section of a highway (step S1). Each of the traffic advisory messages in the bundle describes the traffic-relevant event at a different time within a defined interval. The bundles of traffic advisory messages are sent to a traveler or a service provider of the traveler (step S2). The step of sending uses any communication means that are used for sending traffic messages to travelers. The traveler or terminal of the traveler then selects a relevant message from the bundle of traffic advisory messages (step S3), wherein the relevant message is a a message which describes the event at the time at which the traveler is expected to reach the event. Alternatively, the relevant message may be selected by a service provider for the traveler in step S3. The step S3 of selecting may use an access function n(t)=i, if $T_i-\frac{1}{2}\Delta t \leqq t \leqq T_i+\frac{1}{2}\Delta t$, where i is an index number of traffic advisory messages in the bundle of traffic advisory messages, $T_i$ is a time associated with the traffic advisory message i, t is the time that the traveler will reach the traffic event described by the bundle of traffic advisory messages, and Δt is a time defining the size of the time period for which traffic advisory message i is valid. Each of the traffic advisory messages includes a "transit time" attribute which indicates the time required to drive through the traffic event. The advisory messages may further include transit time matrix information further includes travel time to reported events, travel time between events, and travel time from a last event to a destination. Thus, the transit time of a complete route may be determined from the transit time matrix information (step S4).

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for providing traffic information concerning one or more specific sections of a route to a traveler, comprising the steps of:

generating a bundle of traffic advisory messages for the traveler when an event relevant to the traffic situation has occurred in an affected section of the highway, wherein each of the traffic advisory messages present in the bundle of traffic advisory messages describes the traffic-relevant event in question at a different time within a defined interval; and selecting a relevant message from the bundle of traffic advisory messages which is valid at a time relevant to the traveler.

2. The method for providing traffic information of claim 1, wherein said step of selecting a relevant message is performed by the traveler.

3. The method for providing traffic information of claim 1, further comprising the step of sending the bundle of traffic advisory messages to a terminal of the traveler, wherein said step of selecting a relevant message is performed by the terminal.

4. The method for providing traffic information of claim 1, wherein said step of selecting comprises selecting, by a service provider, the relevant message from the bundle of traffic advisory messages which is valid at a time relevant to the traveler.

5. The method for providing traffic information of claim 1, wherein each of the traffic advisory messages includes an attribute "transit time", which indicates the time which will be required to drive through the traffic event described by the message.

6. The method for providing traffic information of claim 1, wherein the bundle of traffic advisory messages further include a bundle of transit time matrix information, the entries of these matrices indicating at least one of:

a travel time required to drive through the traffic event described by the bundle of traffic advisory messages at the time stated in each of the traffic advisory messages;

a travel time required to drive along the route from a starting point to a first reported event, a travel time between two reported events, and a travel time between the last reported event and a destination of the traveler.

7. The method for providing traffic information of claim 6, wherein the bundle of transit time matrix information has a structure corresponding to that of the bundles of traffic advisory messages, said method further comprising the step of calculating travel times on routes as sums of travel times on free-flowing sections and the transit times through events.

8. The method for providing traffic information of claim 1, further comprising the step of using, for the selection of the relevant time for the choice of the relevant traffic message from the traffic message bundle, the access function n(t)=i if: $T_1-\frac{1}{2}\Delta t \leqq t \leqq T_i+\frac{1}{2}\Delta t$, where i is an index number of traffic advisory messages in the bundle of traffic advisory messages.

$T_1$ is a time associated with the traffic advisory message i, t is the time that the traveler will reach the traffic event described by the bundle of traffic advisory messages, and Δt is a time defining the size of the time period for which traffic advisory message is valid.

9. The method for providing traffic information of claim 1, wherein said step of generating a bundle of traffic advisory messages includes generating a prediction including traffic message bundles with future validity times.

10. The method for providing traffic information of claim 9, wherein said step of generating a bundle of traffic advisory messages includes providing the traffic advisory messages having future validity times with a value characterizing a probability of the prediction.

11. The method for providing traffic information of claim 1, wherein said step of generating a bundle of traffic advisory messages includes generating traffic message bundles with validity times in the past.

12. The method for providing traffic information of claim 1, wherein said step of selecting comprises calculating linear distances and assumed speeds for certain classes of roads to determine a time relevant to the traveler.

13. The method for providing traffic information of claim 1, wherein said traffic advisory messages relate to an overall road network of a certain size.

* * * * *